US005360366A

United States Patent [19]

Lin

[11] Patent Number: 5,360,366

[45] Date of Patent: Nov. 1, 1994

[54] WOBBLING TOY

[75] Inventor: Ivan Lin, Taipei,

[73] Assignee: C.C. Family Overseas Co., Ltd., Taipei,

[21] Appl. No.: 171,653

[22] Filed: Dec. 22, 1993

[51] Int. Cl.[5] ..... A63H 33/26; A63H 13/18; A63H 11/00

[52] U.S. Cl. ..... 446/134; 446/325; 446/352

[58] Field of Search ..... 446/3, 129, 130, 133, 446/134, 135, 136, 325, 326, 352, 396, 330

[56] References Cited

U.S. PATENT DOCUMENTS

| | | | |
|---|---|---|---|
| 1,947,920 | 2/1934 | Primrose | 446/134 |
| 2,471,002 | 5/1949 | Mohr | 446/134 |
| 3,425,157 | 2/1969 | Hartsock | 446/134 |
| 3,717,951 | 2/1973 | Ljungdahl | 446/130 |
| 4,852,283 | 8/1989 | Teng | 446/134 |

FOREIGN PATENT DOCUMENTS

| | | | |
|---|---|---|---|
| 1233884 | 5/1986 | U.S.S.R. | 446/129 |
| 1349763 | 11/1987 | U.S.S.R. | 446/325 |
| 1519727 | 11/1989 | U.S.S.R. | 446/129 |

*Primary Examiner*—Robert A. Hafer

*Assistant Examiner*—Jeffrey D. Carlson

*Attorney, Agent, or Firm*—Christensen, O'Connor, Johnson & Kindness

[57] ABSTRACT

A wobbling toy includes a hollow platform, a first magnet unit a soft toy housing including a head and a body and a driving mechanism. The first magnet unit is disposed horizontally and mounted rotatably adjacent to the top surface of the platform. The driving mechanism is operable so as to drive rotatably the first magnet unit. The toy body unit rests on the top surface of the platform. The toy body unit further includes a pivot plate which has two distal ends connected pivotally to the wall of the toy body and a vertically extending swing rod which has an intermediate portion that extends through and that is connected to the pivot plate. The swing rod further has a lower end with a second magnet unit mounted thereon and disposed adjacent to the platform and an upper end disposed within the head of the soft toy housing. In operation, the first magnet unit is oscillated by the driving mechanism so as to alternately attract and repel the second magnet unit, to cause the swing rod within the toy body unit to swing. As a result, the toy body unit wobbles on the platform and the head of the toy housing wobbles relative to the body thereof.

6 Claims, 6 Drawing Sheets

WOBBLING TOY

BACKGROUND OF THE INVENTION

1. Field Of The Invention

This invention relates to a wobbling toy, more particularly to a magnetic control-type wobbling toy.

2. Description Of The Related Art

Presently, there are many toys available in the market. However, none of these conventional toys can wobble when operated.

SUMMARY OF THE INVENTION

Therefore, the main object of the present invention is to provide a magnetic control-type wobbling toy which can wobble when operated.

According to this invention, a wobbling toy includes a hollow platform, a first magnet unit, a driving mechanism and a toy body unit. The hollow platform has a top surface and a support unit that is disposed inside the platform. The support unit has two spaced upright support plates. The first magnet unit is disposed horizontally and is mounted rotatably between the support plates of the support unit adjacent to the top surface of the platform. The driving mechanism is operable so as to drive rotatably the first magnet unit. The toy body unit includes an upright hollow cylindrical member with a convex bottom wall which rests on the top surface of the platform. The cylindrical member has an inner peripheral wall with two diametrically opposite portions. The toy body unit further includes a pivot plate which has two distal ends that are connected pivotally to the diametrically opposite portions of the inner peripheral wall of the cylindrical member, and a vertically extending swing rod which has an intermediate portion that extends through and that is connected to the pivot plate. The swing rod further has a lower end with a second magnet unit mounted thereon and disposed adjacent to the convex bottom wall of the cylindrical member.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
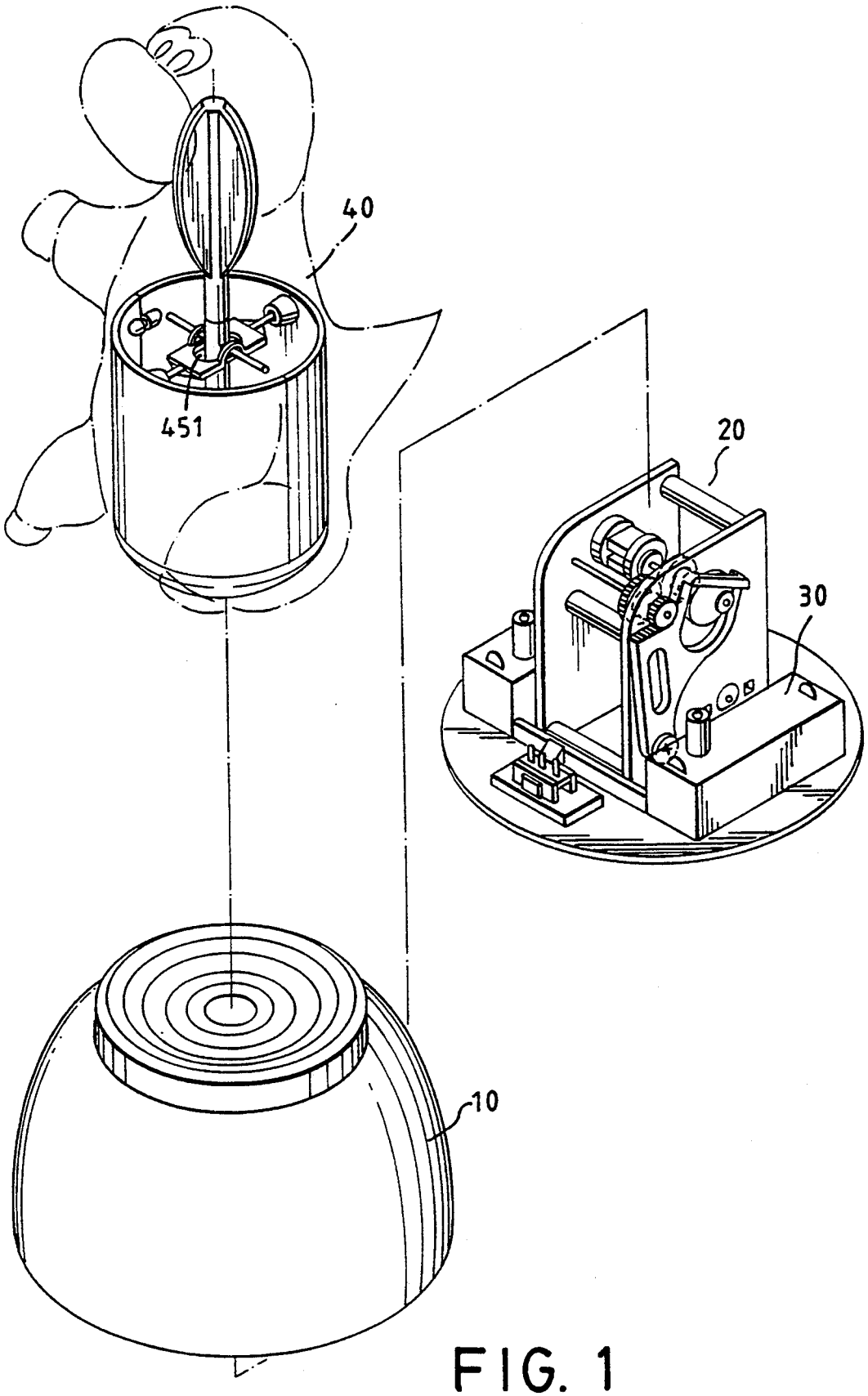
FIG. 1 is a partly exploded view showing a wobbling toy according to a first embodiment of the present invention.
Figure 2:
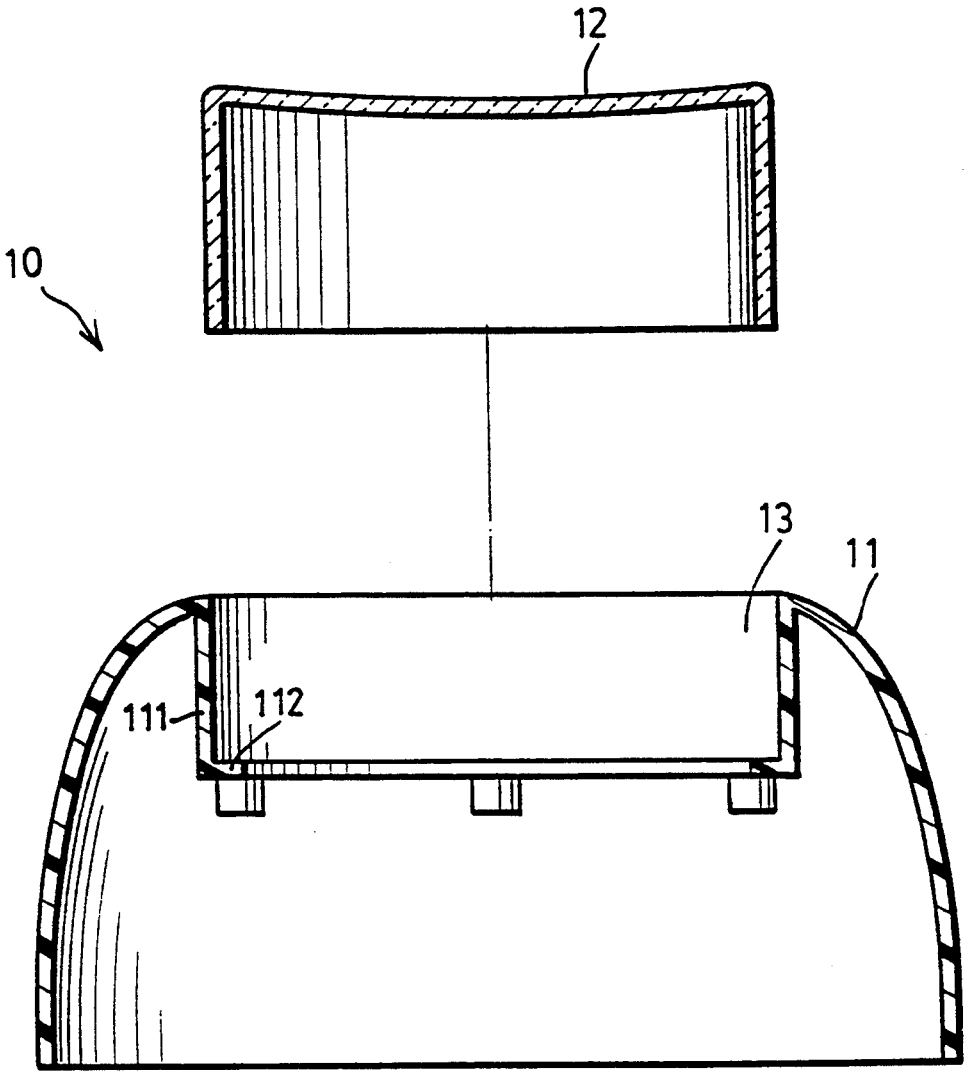
FIG. 2 is an enlarged view showing a hollow platform of the wobbling toy, a support unit of the platform being absent.
Figure 3:
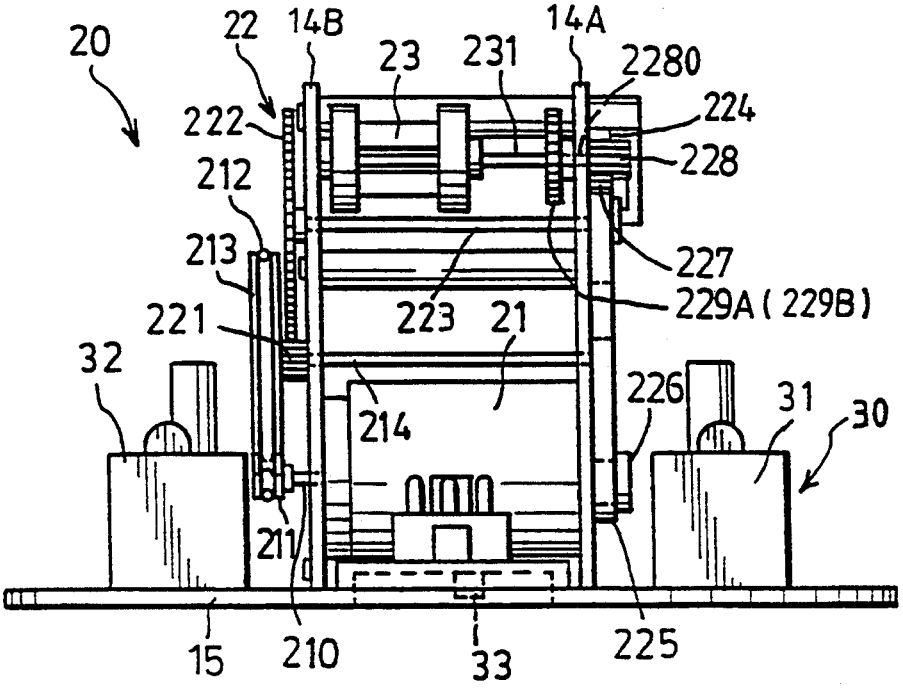
FIG. 3 is a side view showing the support unit on which a first magnet unit and a driving mechanism are mounted.

Referring to FIGS. 1, 2 and 3, a wobbling toy according to a first embodiment of the present invention includes a hollow platform 10, a first magnet unit, a driving mechanism 20 and a toy body unit 40.

The hollow platform 10 includes a hollow body 11. In the present embodiment, the hollow body 11 is an inverted bowl-shaped member having open top and bottom ends. As best shown in FIG. 2, a first annular flange 111 extends downwardly from the open top end of the hollow body 11. A second annular flange 112 extends inwardly from the lower end of the first annular flange 111. The first and second annular flanges 111,112 cooperatively define a receiving space 13 therebetween. A stand 12 is received fittingly in the receiving space 13. The stand 12 has a top surface which serves as a top surface of the platform 10, and an open bottom end. In the present embodiment, the top surface of the stand 12 is a concave surface and the distance between the top surface of the stand 12 and the open bottom end thereof is slightly greater than the distance between the open top end of the hollow body 11 and the second annular flange 112.

As best shown in FIG. 3, the platform further includes a support unit having a base plate 15 and two spaced upright support plates (14A,14B) which are mounted on the base plate 15.

Figure 8:
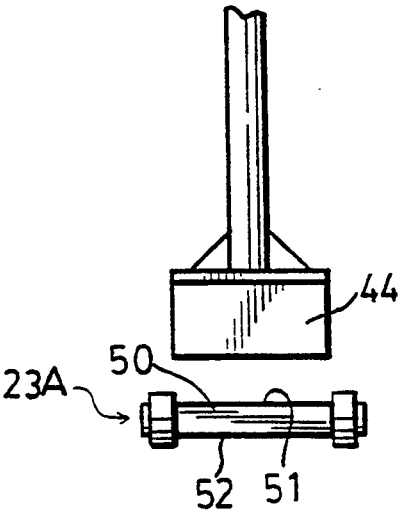
FIG. 8 is an enlarged view showing the relationship between the first and second magnet units of the wobbling toy, wherein the first magnet unit includes a single magnet.
Figure 7:
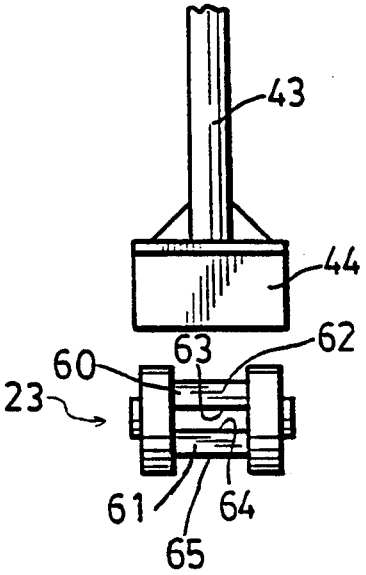
FIG. 7 is an enlarged view showing the relationship between the first and second magnet units of the wobbling toy, wherein the first magnet unit includes a magnet set having two parallel magnets.

The first magnet unit includes a first horizontal axle 231 mounted rotatably between the support plates (14A,14B) adjacent to the top surface of the stand 12 of the platform 10, and a magnet set 23 mounted securely on the first horizontal axle 231. The magnet set 23 includes two parallel magnets 60,61. Each of the magnets 60,61 has a first polarity side 62,64 and a second polarity side 63,65 opposite to the first polarity side 62,64. The first polarity side 64 of the magnet 61 faces the second polarity side 63 of the magnet 60, while the second polarity side 65 of the magnet 61 is opposite to the first polarity side 62 of the magnet 60. It can be seen that the magnet set (23A) (see FIG. 8) may include only one magnet 50 having opposite first and second polarity sides. However, it would be preferable to use the magnet set (23) shown in FIG. 7 because it provides a greater magnetic field.

The driving mechanism 20 includes a motor unit and a transmission mechanism.

The motor unit includes a power supply unit 30 having battery casings 31,32 for receiving batteries (not shown) therein, a motor 21 installed operatively on the base plate 15 between the support plates (14A,14B), and a power switch 33 which interconnects the motor 21 and the power supply unit 30 and which is operable to activate the motor 21. The motor 21 has a driving shaft 210 extending through the support plate (14B) and a driving belt wheel 211 mounted securely on a distal end of the driving shaft 210. The driving shaft 210 is driven rotatably when the motor unit 21 is activated.

Figure 4:
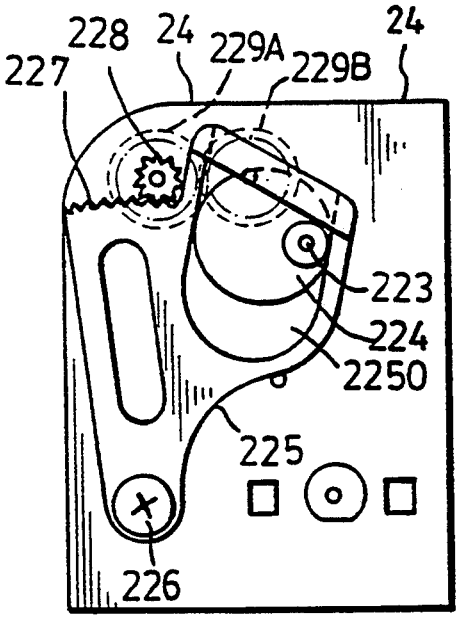
FIG. 4 is another side view of the support unit.
Figure 6:
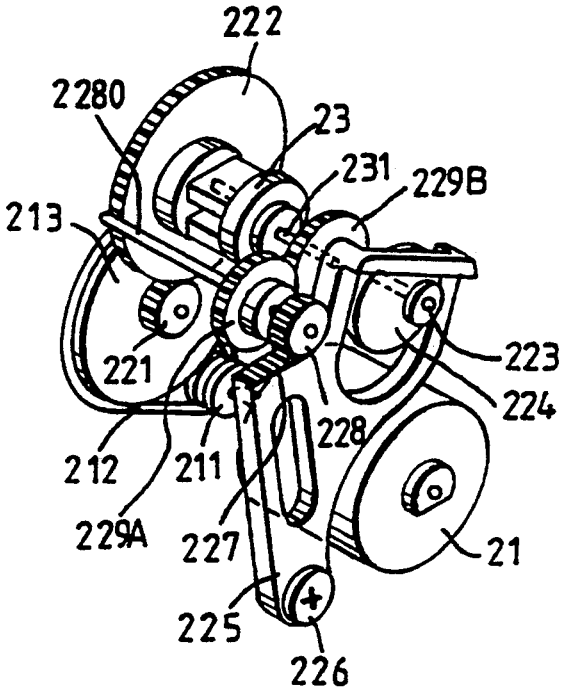
FIG. 6 is a fragmentary view showing the motor unit and the transmission mechanism.

Referring now to FIGS. 3, 4 and 6, the transmission mechanism includes a speed-reducing gear set, an eccentric wheel 224, a pivot member 225, a pinion 228 and a secondary transmission unit.

The speed-reducing gear set includes a second horizontal axle 214 mounted rotatably between the support plates (14A,14B), and a driven belt wheel 213 mounted securely on the second horizontal axle 214. A driving belt 212 interconnects the belt wheels 211,213 so as to transmit rotation of the driving belt wheel 211 to the driven belt wheel 213. It can be seen that the driven belt wheel 213 rotates at a speed slower than that of the driving belt wheel 211. A first cog 221 is mounted securely on the second horizontal axle 214 and is located between the driven belt wheel 213 and the support plate (14B). A third horizontal axle 223 is mounted rotatably between the support plates (14A,14B) at a location above the second horizontal axle 214. A gear 222 is mounted securely on the third horizontal axle 223 and meshes with the first cog 221.

The eccentric wheel 224 is mounted securely on the third horizontal axle 223 at an outer side of the support plate (14A).

The pivot member 225 has a lower end mounted pivotally on the support plate (14A) by means of a bolt 226. The pivot member 225 further has an upper end formed with a rack 227 and a notch 2250 disposed on the right side of the rack 227 (see FIG. 4) so as to receive the eccentric wheel 224 therein.

The pinion 228 is mounted securely on a fourth horizontal axle 2280 which is mounted rotatably between the support plates (14A,14B). The pinion 228 meshes with the rack 227 of the pivot member 225.

The secondary transmission unit includes a second cog (229A) mounted securely on the fourth horizontal axle 2280, and a third cog (229B) which is mounted securely on the first horizontal axle 231 and which meshes with the second cog (229A).

Figure 5:
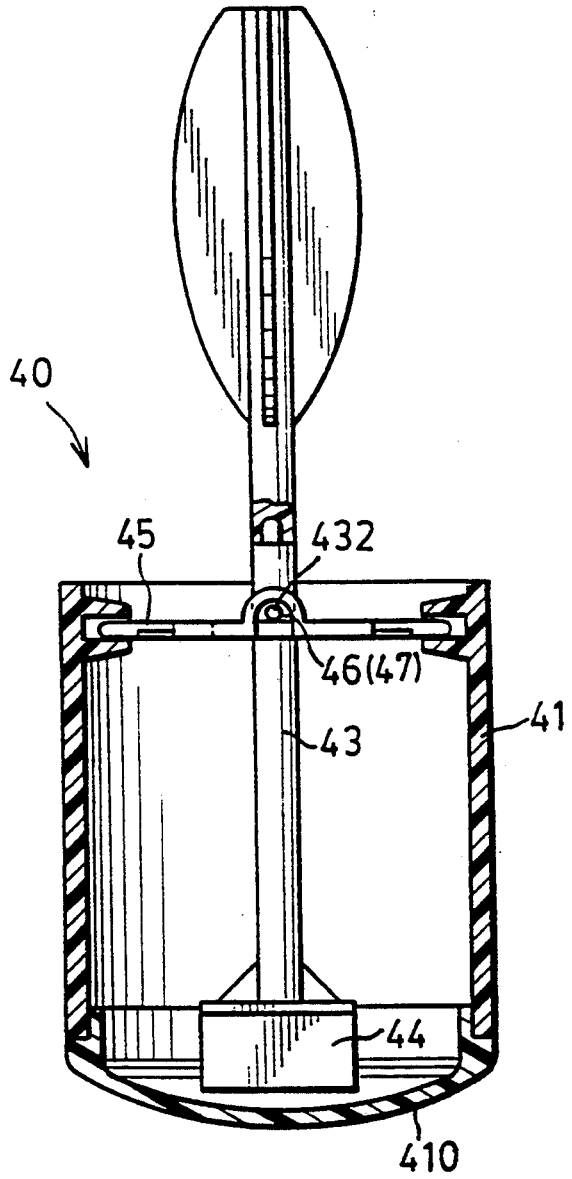
FIG. 5 is a partly sectional view illustrating the structural relationship among an upright hollow cylindrical member, a pivot plate and a vertically extending swing rod of a toy body unit of the wobbling toy according to the first embodiment of the present invention.

Referring now to FIGS. 1 and 5, the toy body unit 40 includes an upright hollow cylindrical member 41, a pivot plate 45 and a vertically extending swing rod 43.

The upright hollow cylindrical member 41 has a convex bottom wall 410 which rests on the top surface of the stand 12 of the platform 10, and an inner peripheral wall with two diametrically opposite portions.

The pivot plate 45 has two distal ends connected pivotally to the diametrically opposite portions of the inner peripheral wall of the cylindrical member 41. The pivot plate 45 is formed with an oval through-hole 451 (see FIG. 1). Two upwardly projecting lugs 46,47 are provided on two opposite sides of the pivot plate 45.

The swing rod 43 extends through the oval through-hole 451 of the pivot plate 45 and is mounted pivotally on the pivot plate 45 at an intermediate portion thereof by means of a pin 432 which extends through the lugs 46,47 and through the intermediate portion of the swing rod 43 so as to permit swinging of the swing rod 43 relative to the pivot plate 45. The swing rod 43 has an enlarged upper end and a lower end with a second magnet unit 44 mounted thereon and disposed adjacent to the convex bottom wall 410 of the cylindrical member 41.

Referring once more to FIG. 1, the toy body unit 40 further includes a soft toy housing (shown in phantom lines) sleeved on the cylindrical member 41 on which the pivot plate 45 with the swing rod 43 is pivotally mounted. In the present embodiment, the soft toy housing is shaped as a dinosaur.

In operation, when the power switch 33 is operated, the motor 21 is activated to cause rotation of the driving belt wheel 211 with the driving shaft 210, thus causing the driven belt wheel 213 and the first cog 221 to rotate. Since the first cog 221 meshes with the gear 222 and since the eccentric wheel 224 and the gear 222 are mounted on the same axle, rotation of the first cog 221 is thus transmitted to the eccentric wheel 224, thus causing the pivot member 225 to pivot reciprocally. At this stage, the rack 227 of the pivot member 225 is moved in a reciprocating manner. Because the pinion 228 meshes with the rack 227, and because the second cog (229A) and the pinion 228 are mounted on the same axle, reciprocating movement of the rack 227 is converted into corresponding rotation of the pinion 228, thus permitting corresponding rotation of the third cog (229B) and thus causing the magnet set 23 to rotate. At this stage, rotation of the magnet set 23 causes the magnet set 23 to attract and repel alternatingly the second magnet unit 44 in order to cause wobbling movement of the toy body unit 40 on the top surface of the stand 12 of the platform 10.

Figure 9:
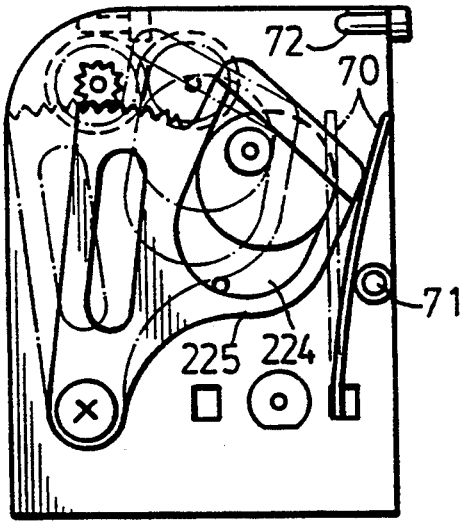
FIG. 9 is a side view similar to that of FIG. 4, showing how a movable switch contact of a switching unit is pushed according to a second embodiment of the present invention.
Figure 10:
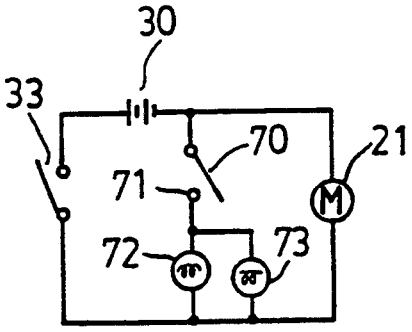
FIG. 10 is a schematic circuit diagram of the wobbling toy according to the second embodiment of the present invention.

Referring now to FIGS. 9 and 10, a second embodiment of the present invention is shown to further comprise a light generating unit. The light generating unit includes a light bulb unit having two light bulbs 72,73 and a switching unit having a stationary switch contact 71 which is mounted on the support plate (14A) (see FIG. 9) and which is connected electrically to a first terminal of the power supply unit 30. The light bulbs 72,73, in the present embodiment, may be installed on the platform 10. The switching unit further includes a movable switch contact 70 which is mounted on the support plate (14A) (see FIG. 9) between the stationary switch contact 71 and the pivot member 225. The movable switch contact 70 is a spring plate and is normally spaced from the stationary switch contact 71. The movable switch contact 70 is connected electrically to a second terminal of the power supply unit 30 and is pushed by the pivot member 225 to contact the stationary switch contact 71 intermittently when the pivot member 225 pivots due to rotation of the eccentric wheel 224, thus activating the light bulbs 72,73 to generate a blinking light output.

In addition, a sound generating unit (not shown) may also be employed in the present invention so as to obtain a more interesting effect.

Accordingly, the present invention will achieve the following results when operated:

1. Since the radius of curvature of the convex bottom wall 410 of the cylindrical men, her 41 is smaller than that of the concave surface of the stand 12 of the platform 10, the toy body unit 40 will not fall down from the platform 10 during operation.
2. Upon actuation of the driving mechanism 20, the magnet set 23 of the first magnet unit oscillates to generate a magnetic field that alternately attracts and then repels the second magnet unit 44, to cause swing rod 43 to swing relative to the pivot plate 45 and the cylindrical member 41. As a result, the toy body unit 40 wobbles on the platform 10 and the head of the toy housing wobbles relative to the body thereof.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A wobbling toy comprising:

a hollow platform having a top surface and a support unit disposed inside said platform, said support unit having two spaced upright support plates;

a first magnet unit disposed horizontally and mounted rotatably between said support plates of said support unit adjacent to said top surface of said platform;

a driving mechanism operable so as to drive rotatably said first magnet unit; and a toy body unit including an upright hollow cylindrical member having a convex bottom wall which rests on said top surface of said platform, said cylindrical member having an inner peripheral wall with two diametrically opposite portions, said toy body unit further including a pivot plate which has two distal ends connected pivotally to said diametrically opposite portions of said inner peripheral wall of said cylindrical member, and a vertically extending swing rod which has an intermediate portion that extends through and that is connected to said pivot plate, said swing rod further having a lower end with a second magnet unit mounted thereon and disposed adjacent to said convex bottom wall of said cylindrical member;

whereby, rotation of said first magnet unit causes said first magnet unit to attract and repel alternatingly said second magnet unit in order to cause wobbling of said toy body unit on said top surface of said platform.

2. A wobbling toy as claimed in claim 1, wherein said top surface of said platform is a concave surface.

3. A wobbling toy as claimed in claim 1, wherein said driving mechanism includes a motor unit and a transmission mechanism connected to said motor unit and said first magnet unit to enable said motor unit to drive rotatably said first magnet unit.

4. A wobbling toy as claimed in claim 3, wherein said transmission mechanism comprises:

a speed-reducing gear set connected to and driven rotatably by said motor unit;

an eccentric wheel driven rotatably by said speed reducing gear set;

a pivot member having a lower end mounted pivotally on one of said support plates and an upper end formed with a rack and a notch disposed on one side of said rack so as to receive said eccentric wheel therein;

a pinion meshing with said rack of said pivot member; and a secondary transmission unit connected to said pinion and said first magnet unit to transmit rotation of said pinion to said first magnet unit.

5. A wobbling toy as claimed in claim 1, wherein said pivot plate is formed with an oval through-hole through which said swing rod extends, two upwardly projecting lugs provided on two opposite sides of said pivot plate, and a pin which extends through said lugs and through said intermediate portion of said swing rod.

6. A wobbling toy as claimed in claim 4, further comprising a light generating unit and a power supply unit for supplying electrical power to said light generating unit and said motor unit, said power supply unit having first and second terminals, said light generating unit including a light bulb unit and a switching unit which is operable to connect said light bulb unit to said power supply unit, said switching unit including a stationary switch contact mounted on one of said support plates and connected electrically to said first terminal of said power supply unit, and a movable switch contact mounted on said one of said support plates between said stationary switch contact and said pivot member, said movable switch contact being normally spaced from said stationary switch contact, said movable switch contact being connected electrically to said second terminal of said power supply unit and being pushed by said pivot member to contact said stationary switch contact intermittently when said pivot member pivots due to rotation of said eccentric wheel.

* * * * *